US007346290B2

(12) United States Patent
Takesawa et al.

(10) Patent No.: US 7,346,290 B2
(45) Date of Patent: Mar. 18, 2008

(54) CLEANING APPARATUS FOR A ROTATABLE MEMBER

(75) Inventors: Yoichi Takesawa, Osaka (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 281 days.

(21) Appl. No.: 11/138,854

(22) Filed: May 25, 2005

(65) Prior Publication Data

US 2005/0265745 A1 Dec. 1, 2005

(30) Foreign Application Priority Data

May 27, 2004 (JP) ..... 2004-157951
May 17, 2005 (JP) ..... 2005-144210

(51) Int. Cl.
*G03G 15/02* (2006.01)

(52) U.S. Cl. ..... 399/100

(58) Field of Classification Search ..... 399/91, 399/98, 99, 100, 168, 174, 175, 176
See application file for complete search history.

(56) References Cited

U.S. PATENT DOCUMENTS 5,946,529 A * 8/1999 Sato et al. ..... 399/100
6,088,551 A * 7/2000 Satoh et al. ..... 399/100
6,263,175 B1 * 7/2001 Sawada et al. ..... 399/100
6,381,432 B1 * 4/2002 Hattori ..... 399/176

FOREIGN PATENT DOCUMENTS

| | | |
|---|---|---|
| CN | 1164680 | 12/1997 |
| JP | 8-50398 | 2/1996 |
| JP | 09-043937 | 2/1997 |
| JP | 2000-187373 | 7/2000 |
| JP | 2001-337519 | 12/2001 |

* cited by examiner

*Primary Examiner*—Hoan Tran
(74) *Attorney, Agent, or Firm*—David G. Conlin; Lisa Swiszcz Hazzard; Edwards Angell Palmer & Dodge LLP

(57) ABSTRACT

The cell wall removal ratio of an elastic foam body is set such that developer or other fouling material adhering to a rotatable member can be continuously absorbed through the cells of the elastic foam body during a single maintenance cycle of an image forming apparatus. For example, the cell wall removal ratio of the elastic foam body is set to at least 60% or at least 80%. When the cell wall removal ratio of the elastic foam body is set to at least 60%, good image quality can be maintained reliably until the number of sheets recorded by the image forming apparatus reaches 20000. Furthermore, when the cell wall removal ratio of the elastic foam body is set to at least 80%, good image quality can be maintained reliably until the number of sheets recorded by the image forming apparatus reaches 30000.

14 Claims, 8 Drawing Sheets

| | toner removal efficiency | | | |
|---|---|---|---|---|
| cell wall removal ratio | initial | after 10K | after 20K | after 30K |
| 10 | ○ | × | × | × |
| 20 | ○ | × | × | × |
| 40 | ○ | ○ | × | × |
| 50 | ○ | ○ | ○ | × |
| 60 | ○ | ○ | ○ | ○ |
| 80 | ○ | ○ | ○ | ○ |
| 90 | ○ | ○ | ○ | ○ |

$K = 10^3$

CLEANING APPARATUS FOR A ROTATABLE MEMBER

CROSS REFERENCE TO RELATED APPLICATIONS

This application claims priority under 35 U.S.C. §119(a) on Patent Application No. 2004-157951 filed in Japan on May 27, 2004, and on Patent Application No. 2005-144210 filed in Japan on May 17, 2005, the entire contents of which are hereby incorporated by reference.

BACKGROUND OF THE INVENTION

The present invention relates to a cleaning apparatus for a rotatable member used in an electrophotographic image forming apparatus.

In a known electrophotographic image forming apparatus, a photosensitive drum (an electrostatic latent bearing members) is rotated while a charging apparatus is used to apply a uniform electrostatic charge to the surface of the photosensitive drum, and a light beam is used to scan the surface of the photosensitive drum, thereby forming an electrostatic latent image on the photosensitive drum. A developer is applied to the electrostatic latent image upon the photosensitive drum, thus forming a development image upon the photosensitive drum, the development image is transferred from the photosensitive drum to recording paper and the development image on the recording paper is fixed by heat and pressure.

Here, the charging apparatus may be, for example, one wherein the charge is applied by corona discharge, or one wherein a brush is provided in the charging apparatus and the charge is applied by contact with the brush. With the former corona-discharge type of charging apparatus, the charge is applied to the photosensitive drum in a non-contact manner. Therefore, it has an advantage in that the charge on the photosensitive drum surface is uniform. However, it also has a drawback in that it generates large amounts of ozone.

On the other hand, with the latter brush-contact type of charging apparatus, a brush to which a bias voltage is applied is brought into contact with the surface of the photosensitive drum, thus applying a charge to the photosensitive drum. Accordingly, this has an advantage in that virtually no ozone is generated.

However, with the brush-contact type of charging apparatus, there is a drawback in that residual developer on the photosensitive drum or other fouling material may adhere to the brush, thus fouling the brush. This fouling of the brush could cause uneven charging or damage to the photosensitive drum, thus leading to degraded image quality.

More specifically, the developer on the photosensitive drum cannot be transferred onto recording paper at 100% transfer efficiency, resulting in residual developer on the photosensitive drum. This residual developer can be removed by bringing a cleaning rubber blade or the like in contact with (pressing) the surface of the photosensitive drum with a sufficient pressure. However, increasing the pressing strength of the rubber blade would scrape the photosensitive layer of the photosensitive drum, and therefore, the pressing strength of this rubber blade cannot be sufficiently strong. Accordingly, those components of the residual developer that have a small particle size, or those components of the residual developer that can form a strong electrostatic bond with the photosensitive drum cannot be removed, and the components of the residual developer on the photosensitive drum that have not been removed are absorbed electrostatically and caused to adhere to the brush of the charging apparatus.

For this reason, the brush-contact type of charging apparatuses are often provided with a cleaning mechanism for removing developer or the like adhering to the brush.

For example, in JP 2000-187373A (hereinafter referred to as "Patent Document 1"), the photosensitive drum and the rotatable member are rotated in directions opposite each other so that the charge is applied to the photosensitive drum while their outer circumferences are moving in the same direction in their areas of contact. Furthermore, the brush cleaner is rotated while the flocking of the rotatable member are pressed against the brush cleaner to remove fouling material from the rotatable member.

However, in Patent Document 1, although developer adhering to the flocking of the rotatable member is removed by the brush cleaner, there is no description on the removal of the developer adhering to the brush cleaner. Therefore, when the amount of the developer adhering to the brush cleaner increases, there is the possibility that the developer adhering to the brush cleaner may be reversely transferred to the rotatable member. Therefore, it cannot be said that the developer adhering to the flocking of the rotatable member is removed reliably.

In addition, another method for removing developer or the like adhering to the brush is to electrically remove residual developer from the brush. However, with this method, the electric field for removing the residual developer has a polarity opposite the polarity of charge of the photosensitive drum, producing an adverse effect on the charging characteristics of the photosensitive drum.

Moreover, such problems with rotatable members occur also with discharge brushes used to make contact with and discharge a photosensitive drum or the like, and cleaning brushes used to make contact with and clean a photosensitive drum or the like, causing uneven discharging and cleaning. That is to say, developer or other fouling material adheres to the rotatable member, resulting in unevenness in the characteristics of the rotatable member.

The present invention has been devised in consideration of these issues, and an object thereof is to provide a cleaning apparatus for a rotatable member by which it is possible to remove developer or other fouling material adhering to the rotatable member reliably and to prevent the disorder of the rotatable member.

SUMMARY OF THE INVENTION

In order to solve these problems, a cleaning apparatus for a rotatable member according to the present invention is a cleaning apparatus for a rotatable member for cleaning a rotatable member that abuts upon or slides along an electrostatic latent bearing member in order to apply an electric potential to the electrostatic latent bearing member, including: an elastic foam body with open cells that is pressed against by the rotating member, wherein a cell wall removal ratio corresponding to a ratio of the open cells of the elastic foam body is set in accordance with a maintenance cycle.

According to the present invention, the elastic foam body with open cells that is pressed against by the rotatable member is provided. A large number of cell (bubble) holes are formed in the surface of this elastic foam body, and when the rotatable member presses against this elastic foam body, any developer or other fouling material adhering to the rotatable member is removed by the cell holes in the surface of the elastic foam body, and moreover the developer or other fouling material passes through the cells and is absorbed into the interior of the elastic foam body. Thus, developer or other fouling material adhering to the rotatable member is reliably removed, thus preventing uneven charging or damage to the electrostatic latent bearing members caused by developer or other fouling material adhering to the rotatable member. Furthermore, in the present invention, a cell wall removal ratio corresponding to a ratio of the open cells of the elastic foam body is set in accordance with a maintenance cycle. Here, the higher the cell wall removal ratio of the elastic foam body is, the higher the probability of connection between the cells of the elastic foam body is, so that developer or other fouling material can more quickly pass through the cells of the elastic foam body and even more developer or other fouling material can be absorbed. Accordingly, if the cell wall removal ratio of the elastic foam body is set to such a level that allows developer or other fouling material adhering to the rotatable member to be sufficiently absorbed during a single maintenance cycle, then the ability of the elastic foam body to absorb developer or other fouling material can be maintained until the time when maintenance is performed, thus making it possible to simplify the maintenance.

Furthermore, to solve the above-described problems, a cleaning apparatus for a rotatable member according to the present invention is a cleaning apparatus for a rotatable member for cleaning a rotatable member that abuts upon or slides along an electrostatic latent bearing member in order to apply an electric potential to the electrostatic latent bearing member, including: an elastic foam body with open cells that is pressed against by the rotating member, wherein a cell wall removal ratio corresponding to a ratio of the open cells of the elastic foam body is set to at least 60%.

According to the present invention, the elastic foam body with open cells that is pressed against by the rotatable member is provided. A large number of cell (bubble) holes are formed in the surface of this elastic foam body, and when the rotatable member presses against this elastic foam body, any developer or other fouling material adhering to the rotatable member is removed by the cell holes in the surface of the elastic foam body, and moreover the developer or other fouling material passes through the cells and is absorbed into the interior of the elastic foam body. Thus, developer or other fouling material adhering to the rotatable member is reliably removed, thus preventing uneven charging or damage to the electrostatic latent bearing members caused by developer or other fouling material adhering to the rotatable member. Moreover, according to the present invention, the cell wall removal ratio is set to at least 60%. Empirically, if the cell wall removal ratio of the elastic foam body is set to at least 60%, then the ability of the elastic foam body to absorb developer or other fouling material can be sufficiently maintained during a period in which about 20000 sheets of paper are recorded by an image forming apparatus.

Furthermore, to solve the above-described problems, a cleaning apparatus for a rotatable member according to the present invention is a cleaning apparatus for a rotatable member for cleaning a rotatable member that abuts upon or slides along an electrostatic latent bearing member in order to apply an electric potential to the electrostatic latent bearing member, including: an elastic foam body with open cells that is pressed against by the rotating member, wherein a cell wall removal ratio corresponding to a ratio of the open cells of the elastic foam body is set to at least 80%.

According to the present invention, the elastic foam body with open cells that is pressed against by the rotatable member is provided. A large number of cell (bubble) holes are formed in the surface of this elastic foam body, and when the rotatable member presses against this elastic foam body, any developer or other fouling material adhering to the rotatable member is removed by the cell holes in the surface of the elastic foam body, and moreover the developer or other fouling material passes though the cells and is absorbed into the interior of the elastic foam body. Thus, developer or other fouling material adhering to the rotatable member is reliably removed, thus preventing uneven charging or damage to the electrostatic latent bearing member caused by developer or other fouling material adhering to the rotatable member. Moreover, according to the present invention, the cell wall removal ratio is set to at least 80%. Empirically, if the cell wall removal ratio of the elastic foam body is set to at least 80%, then the ability of the elastic foam body to absorb developer or other fouling material can be sufficiently maintained during a period in which about 30000 sheets of paper are recorded by an image forming apparatus.

In the present invention, the cell wall removal ratio may be adjusted by pressurizing the elastic foam body.

In this case, since the cell wall removal ratio is adjusted by pressurizing the elastic foam body, the cell wall removal ratio can be increased by increasing the pressure applied to the elastic foam body, or by increasing the number of times of pressurization.

Furthermore, in the present invention, the cell wall removal ratio may be adjusted by impregnating the elastic foam body with a solvent.

In this case, since the cell wall removal ratio is adjusted by impregnating the elastic foam body with a solvent, the cell wall removal ratio can be increased by increasing the amount of the solvent with which the elastic foam body is impregnated, or by extending the period of time of impregnation.

In the present invention, an outer circumferential surface of the elastic foam body that is pressed against by the rotatable member may be formed by polishing or cutting.

In this case, the outer circumferential surface of the elastic foam body that is pressed against by the rotatable member is formed by polishing or cutting. By this polishing or cutting, the cross section of the edges of the cell holes that are exposed on the outer circumferential surface of the elastic foam body can be sharpened, so that developer or other fouling material can be favorably removed by the sharpened edges of the cell holes.

In the present invention, the cross section of edges of cell holes that are exposed on an outer circumferential surface of the elastic foam body may be sharpened by polishing or cutting, with a direction of the polishing or cutting with respect to the outer circumferential surface of the elastic foam body being set constant.

In this case, since the cross section of the edges of the cell holes that are exposed on the outer circumferential surface of the elastic foam body is sharpened by polishing or cutting, with the direction of the polishing or cutting with respect to the outer circumferential surface of the elastic foam body being set constant, it is possible to further enhance the removal of fouling material by the cell holes in the outer circumferential surface of the elastic foam body.

In the present invention, the elastic foam body may press against the rotatable member, with the elastic foam body being disposed such that the orientation of the edges of the cell holes whose cross section has been sharpened is opposite a direction of movement of the outer circumference of the rotatable member.

In this case, since the elastic foam body presses against the rotatable member, with the elastic foam body being disposed such that the orientation of the edges of the cell holes whose cross section has been sharpened is opposite a direction of movement of the outer circumference of the rotatable member, it is possible to further enhance the removal of fouling material by the cell holes in the outer circumferential surface of the elastic foam body.

Another cleaning apparatus for a rotatable member according to the present invention is a cleaning apparatus for a rotatable member for cleaning a rotatable member that abuts upon or slides along an electrostatic latent bearing member in order to apply an electric potential to the electrostatic latent bearing member, including: an elastic foam body that is pressed against by the rotatable member downstream in a direction of rotation of the rotatable member from an area of contact with the electrostatic latent bearing member.

According to the another cleaning apparatus of the present invention, the elastic foam body that is pressed against by the rotatable member is provided downstream in a direction of rotation of the rotatable member from an area of contact with the surface of the electrostatic latent bearing member. Here, the elastic foam body is pressed against the rotatable member, and the elastic foam body removes developer or other fouling material adhering to the rotatable member. Thereby, uneven charging of the surface of the electrostatic latent bearing member caused by developer or other fouling material adhering to the rotatable member is prevented.

Still another cleaning apparatus for a rotatable member according to the present invention is a cleaning apparatus for a rotatable member for cleaning a rotatable member that abuts upon or slides along an electrostatic latent bearing member in order to apply an electric potential to the electrostatic latent bearing member, including: a slide member that is pressed against by the flocking of the rotatable member downstream in a direction of rotation of the rotatable member from an area of contact with the electrostatic latent bearing member; and an elastic foam body that is pressed against by the flocking of the rotatable member downstream in the direction of rotation of the rotatable member from the slide member, wherein the slide member has a smooth surface so that the orientations of the flocking of the rotatable member are aligned by the flocking of the rotatable member pressing against the smooth surface.

According to the still another cleaning apparatus of the present invention, the slide member that is pressed against by the flocking of the rotatable member is provided downstream in a direction of rotation of the rotatable member from an area of contact with the surface of the electrostatic latent beating member, and the elastic foam body that is pressed against by the flocking of the rotatable member is provided further downstream. Here, the slide member not only aligns the flocking of the rotatable member in a certain direction, but also presses apart the plurality of flocking of the rotatable member to expose the vicinity of the base of each of the flocking. Then, the elastic foam body provided downstream from the slide member is pressed against the vicinity of the base of each of the flocking, and the elastic foam body removes developer or other fouling material adhering to the vicinity of the base of each of the flocking. Thereby, uneven charging of the surface of the electrostatic latent bearing member caused by developer or other fouling material adhering to the flocking of the rotatable member, and uneven charging of the surface of the electrostatic latent bearing member due to disorder in the orientations of the flocking of the rotatable member are prevented.

Furthermore, in the case where the rotatable member has flocking on its the outer circumference, when the rotatable member presses against the elastic foam body, the orientations of the flocking of the rotatable member are disordered. To solve this problem, the flocking of the rotatable member are aligned in a certain direction by pressing the flocking of the rotatable member against a smooth surface of the slide member. Thus, it is possible to prevent uneven charging of the surface of the electrostatic latent bearing member caused by disorder in the orientation of the flocking of the rotatable member. Accordingly, the elastic foam body presses against the flocking of the rotatable member and removes any developer or other fouling material adhering to the flocking of the rotatable member, and the flocking of the rotatable member disordered at this time then press against the slide member to align the flocking of the rotatable member in a certain direction. Thus, uneven charging of the surface of the electrostatic latent bearing member caused by developer or other fouling material adhering to the flocking of the rotatable member is prevented, and uneven charging of the surface of the electrostatic latent bearing member due to disorder in the orientation of the flocking of the rotatable member does not occur.

In the present invention, the elastic foam body may be an elastic foam body with open cells.

In this case, an elastic foam body with open cells is used. With this elastic foam body with open cells, the cells formed by the open cells are connected, so that developer or other fouling material quickly passes through the cells so that even more developer or other fouling material can be absorbed.

In the present invention, the elastic foam body may have a contacting face that contacts the rotatable member, a discharge face that discharges developer or the like that enters the elastic foam body, and all faces other than the contacting face and the discharge face are sealed.

In this case, all of the faces of the elastic foam body other than the contacting face that contacts the rotatable member and the discharge face that discharges developer or the like that enters the elastic foam body are sealed, so that developer or other fouling material adhering to the rotatable member is absorbed from the contacting face of the elastic foam body, passes through the cells in the elastic foam body and is furthermore discharged from the discharge face of the elastic foam body. Thereby, a large amount of developer or other fouling material can be removed from the rotatable member.

In the present invention, the rotatable member may contact the bottom surface of the electrostatic latent bearing member.

In this case, since the rotatable member contacts the bottom surface of the electrostatic latent bearing member, developer or other fouling material from the rotatable member does not go against the force of gravity and is removed by the cells of the elastic foam body, and thus developer or other fouling material passes through the cells and flows toward the discharge face, thereby increasing the efficiency of removal of fouling material.

DESCRIPTION OF THE PREFERRED EMBODIMENTS

Hereinafter, preferred embodiments of the present invention will be described in detail with reference to the accompanying drawings. Note that in the following embodiments, the present invention is applied to a rotatable brush serving as a rotatable member.

Embodiment 1

Figure 1:
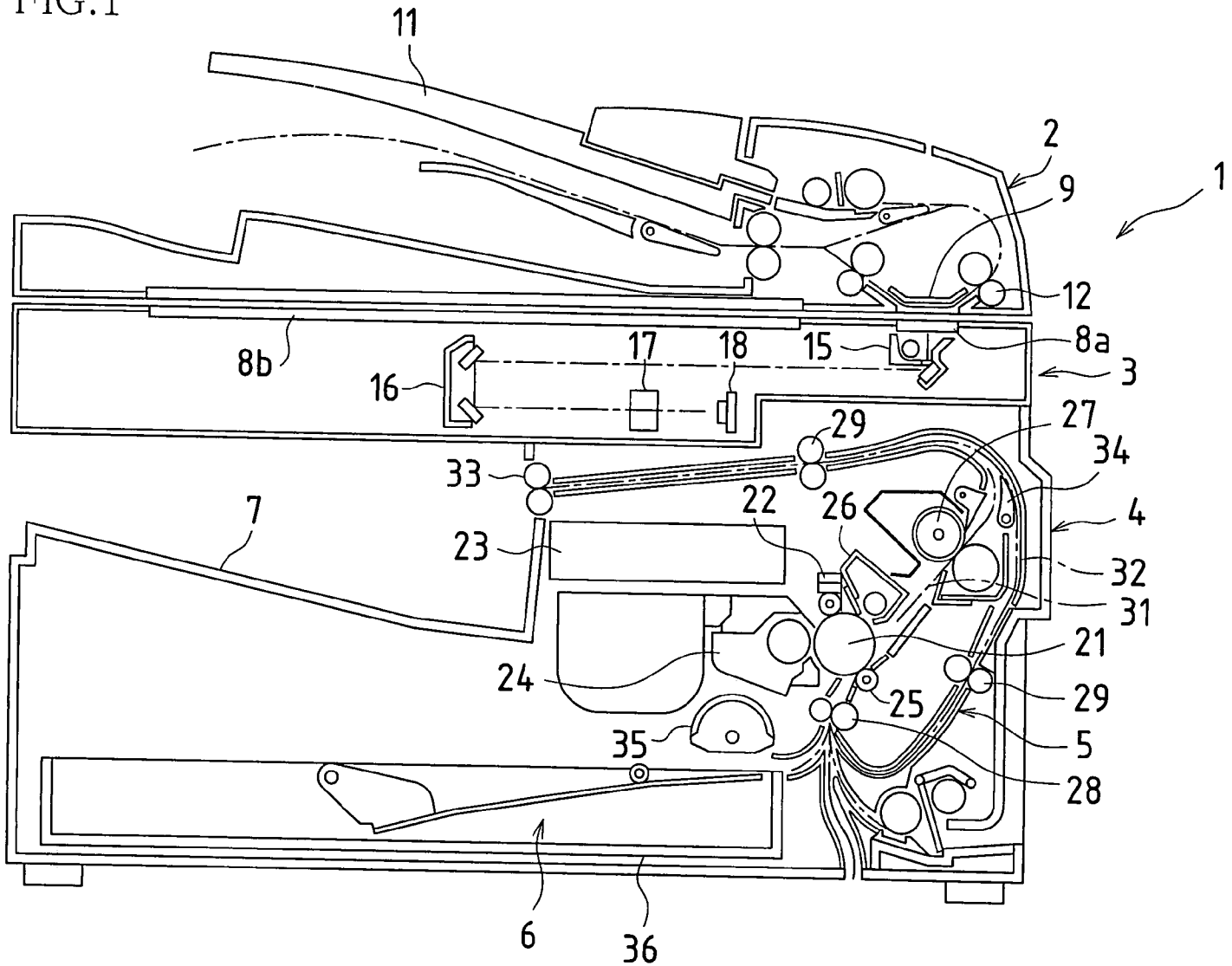
FIG. 1 is a side view showing an image forming apparatus to which the present invention is applied.

FIG. 1 is a side view showing an image forming apparatus to which the present invention is applied. This image forming apparatus 1 is provided with an original carrying unit 2, an original reading apparatus 3, a printing unit 4, a recording paper carrying unit 5, a paper-supply unit 6 and a paper-discharge tray 7.

In the original carrying unit. 2, when at least one original is loaded into an original loading tray 11, the originals are picked up and carried one sheet at a time from the original loading tray 11, and when the leading edge of an original reaches PS rollers 12, the carrying of the original is temporarily halted with the leading edge of the original brought parallel to the PS rollers 12. Then, after reaching synchronization with the image recording operation of the printing unit 4, a clutch between the PS rollers 12 and a driveshaft is engaged, driving the PS rollers 12 to rotate so that the original is again carried by the PS rollers 12 and the original is passed between a platen glass 8*a* and an original presser plate 9.

In the original reading apparatus 3, when an original is carried in, the original is exposed with a first scanning unit 15, the light reflected from the original is guided to an imaging lens 17 by the first and second scanning units 15 and 16, so that an image of the original is formed by the imaging lens 17 upon a photoelectric transducer element (hereinafter referred to as a CCD) 18. The CCD 18 repeatedly scans over the original in the main scanning direction, thus reading and providing output of image data representing the original.

In addition, when an original is placed on a platen glass 8*b*, the first and second scanning units 15 and 16 move such that a predetermined speed relative to each other is maintained, and while the original on the platen glass 8*b* is exposed with the first scanning unit 15, the light reflected from the original is guided to the imaging lens 17 by the first and second scanning units 15 and 16, so that an image of the original is formed by the imaging lens 17 upon the CCD 18.

The image data output from the CCD 18 is subjected to various types of image processing under the control of a microcomputer or other type of control circuit and then output to the printing unit 4.

The printing unit 4 is used to record the image of the original represented by image data onto recording paper, being provided with a photosensitive drum 21, a brush-based charging apparatus 22, a laser scan unit (hereinafter abbreviated LSU) 23, a developing unit 24, a transfer unit 25, a cleaning unit 26, a discharging unit (not shown), a fixing unit 27 and other components. The photosensitive drum 21 rotates in one direction as its surface is cleaned by the cleaning unit 26 and the discharging unit, and then its surface is charged uniformly by the brush-based charging apparatus 22. The LSU 23 modulates a laser beam based on the image data, and this laser beam is used to repeatedly scan over the surface of the photosensitive drum 21 in the main scanning direction, thus forming an electrostatic latent image on the surface of the photosensitive drum 21. The developing unit 24 supplies toner to the surface of the photosensitive drum 21 to develop the electrostatic latent image and thus form a visible image in toner on the surface of the photosensitive drum 21. The transfer unit 25 transfers the visible toner image from the surface of the photosensitive drum 21 to recording paper that is carried in by the recording paper carrying unit 5. The fixing unit 27 applies heat and pressure to the recording paper in order to fix the visible toner image upon the recording paper. Thereafter, the recording paper is further carried by the recording paper carrying unit 5 to the paper-discharge tray 7 and discharged.

In order to carry recording paper, the recording paper carrying unit 5 is provided with PS rollers 28, carry rollers 29, a carrying path 31, a reversing carrying path 32, paper-discharge rollers 33, a branching gate 34 and other components. In the carrying path 31, recording paper is received from the paper-supply unit 6, and when the leading edge of the recording paper reaches the PS rollers 28, the carrying of the recording paper is temporarily halted with the leading edge of the recording paper brought parallel to the PS rollers 28. Thereafter, the recording paper is carried by the PS rollers 28 to the transfer unit 25 of the printing unit 4, and moreover the recording paper is carried to the paper-discharge tray 7. In addition, when an image is also to be recorded on the back side of the recording paper, the branching gate 34 is rotated and moved to switch to the branch of the carrying path 31 and the reversing carrying path 32, so that the recording paper is carried in the opposite direction from the carrying path 31 to the reversing carrying path 32. In the reversing carrying path 32, when recording paper is received from the carrying path 31, the recording paper is reversed back to front and then the recording paper is returned to the PS rollers 28 of the carrying path 31. Thereby, an image is also recorded on the back surface of the recording paper. Upon these carrying paths 31 and 32 are disposed a plurality of detector switches for detecting the passage of the recording paper, and control of the timing of carrying recording paper and the like is conducted based on detection by the various detector switches.

The paper-supply unit 6 holds unused recording paper and is used to supply this unused recording paper to the recording paper carrying unit 5, being provided with a paper-supply cassette 36. The paper-supply cassette 36 holds stacked recording paper, so that a half-moon-shaped pickup roller 35 is used to pick up and carry recording paper one sheet at a time. The recording paper is picked up from the paper-supply cassette 36 and carried to the PS rollers 28.

Figure 2:
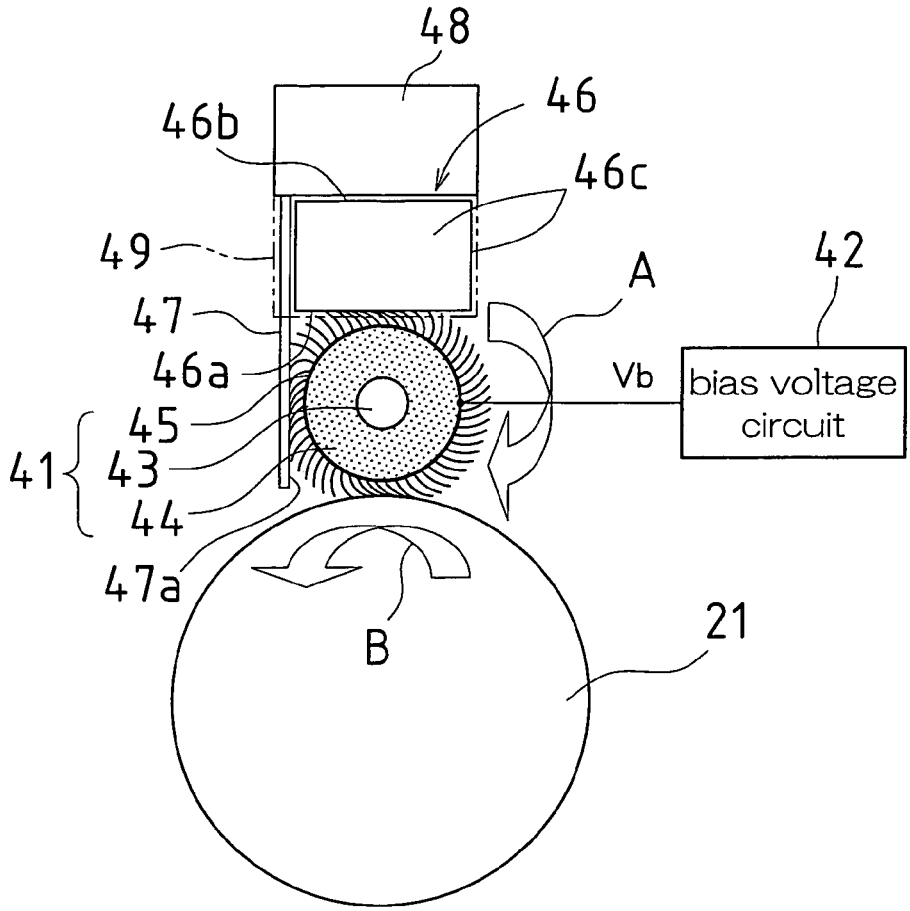
FIG. 2 is a side view showing a brush-based charging apparatus in the image forming apparatus of FIG. 1.

Here follows a more detailed description of the brush-based charging apparatus 22. FIG. 2 is a side view showing the brush-based charging apparatus 22. In this brush-based charging apparatus 22, the bias voltage $V_b$ of a bias voltage circuit 42 is applied to a rotatable member 41, and the rotatable member 41 presses against the surface of the photosensitive drum 21 while the rotatable member 41 and photosensitive drum 21 are rotated in the respective directions indicated by the arrows A and B at the same circumferential speed, and thus a charge is applied to the surface of the photosensitive drum 21.

The rotatable member 41 includes a rotating shaft 43 around which is provided elastic material 44, and brush cloth 45 is wrapped around the elastic material 44, with the rotating shaft 43 and the elastic material 44 disposed concentrically. The rotating shaft 43 is made of metal, and the elastic material 44 and the brush cloth 45 are conductive. Accordingly, the bias voltage $V_b$ of the bias voltage circuit 42 can be applied to the brush cloth 45 through the rotating shaft 43 and the elastic material 44.

The bias voltage $V_b$ applied by the bias voltage circuit 42 to the rotatable member 41 may be a DC voltage or a DC voltage overlaid with an AC voltage.

When a DC bias voltage $V_b$ is used, the amount of ozone generated may be reduced.

In addition, when a bias voltage $V_b$ consisting of a DC voltage overlaid with an AC voltage is used, while the amount of ozone generated increases, it is possible to suppress unevenness in the charge on the surface of the photosensitive drum 21 further. This is because even when a rapid injection of charge occurs from the tip of a flocking of the rotatable member 41 to the surface of the photosensitive drum 21, the midsections of the other flocking of the rotatable member 41 make contact with the location of the rapid injection of charge, and the excess charge in this location is discharged due to the application of AC voltage from the other flocking, thus causing the potential at this location to become equal to the potential of the surroundings. The amplitude voltage of the AC voltage is preferably about twice the DC voltage or greater.

Figure 3:
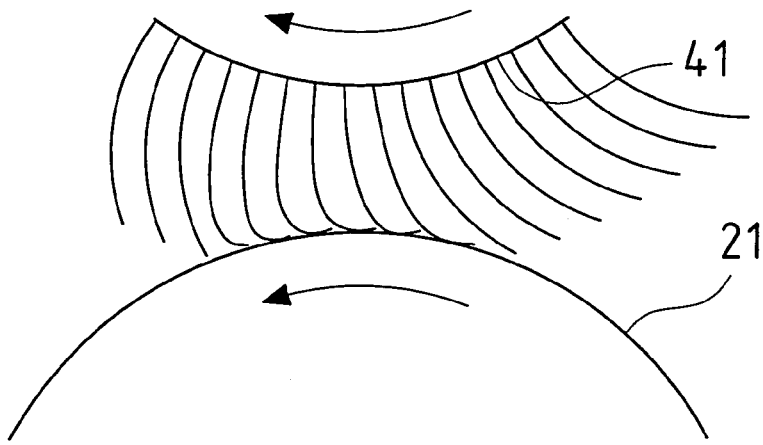
FIG. 3 is an enlarged side view showing the state of contact between the rotatable member and the photosensitive drum in the brush-based charging apparatus of FIG. 2.

Here, when the rotatable member 41 presses against the surface of the photosensitive drum 21 while the rotatable member 41 and the photosensitive drum 21 are rotated in the respective directions indicated by the arrows A and B at the same circumferential speed, in the area of contact between the rotatable member 41 and the photosensitive drum 21, the outer circumference of the rotatable member 41 and the outer circumference of the photosensitive drum 21 are both moving in the same direction at the same speed. The flocking of the rotatable member 41 have their orientation of inclination set so that their grain is in the direction of rotation of the surface of the photosensitive drum 21. For this reason, as shown in FIG. 3, the tips of the flocking of the rotatable member 41 do not strike the surface of the photosensitive drum 21 straight on, but rather the midsections of the flocking of the rotatable member 41 glide over the surface of the photosensitive drum 21.

Thereby, disorder of the rotatable member 41 due to the tips of its flocking striking the surface of the photosensitive drum 21 straight on is prevented, and the flocking of the rotatable member 41 glide over the surface of the photosensitive drum 21 and stream in the direction of the outer circumference of the rotatable member 41, so that the flocking of the rotatable member 41 are constantly aligned in the circumferential direction.

If the flocking of the rotatable member 41 are constantly aligned in the circumferential direction in this manner, then no disorders in the lie of the flocking will be reflected as uneven charging of the surface of the photosensitive drum 21, so that the surface of the photosensitive drum 21 will be uniformly charged. Where any disorders in the lie of the flocking of the rotatable member 41 to occur, the disorders in the lie of flocking would be reflected as uneven charging of the surface of the photosensitive drum 21.

In addition, the tips of the flocking of the rotatable member 41 do not strike the surface of the photosensitive drum 21 straight on, so that no rapid injection of charge occurs from the tips of flocking of the rotatable member 41 to the photosensitive drum 21, and thus no unevenness in the charge on the surface of the photosensitive drum 21 due to such rapid injection of charge occurs. Were the tips of the flocking of the rotatable member 41 to strike the surface of the photosensitive drum 21 straight on, a rapid injection of charge would occur from the tips of flocking of the rotatable member 41 to the surface of the photosensitive drum 21, causing unevenness in the charge on the surface of the photosensitive drum 21.

Figure 4:
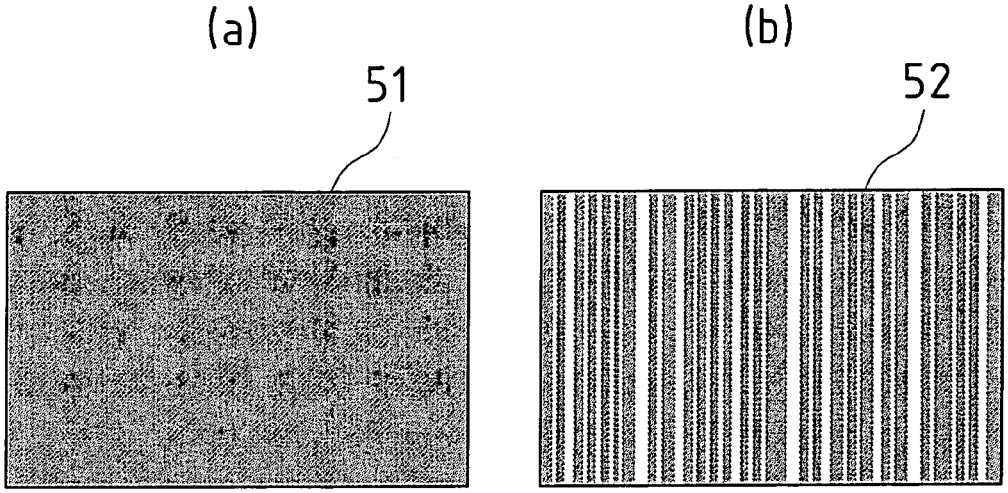
FIG. 4(*a*) and FIG. 4(*b*) are diagrams illustrating a comparison between a gray image formed using the brush-based charging apparatus of FIG. 2 and a gray image formed using a comparative example of a brush-based charging apparatus.

FIG. 4(*a*) and FIG. 4(*b*) are diagrams illustrating a comparison between a gray image 51 with a certain grayscale level recorded in the state wherein the flocking of the rotatable member 41 glide along the surface of the photosensitive drum 21 as in this embodiment, and a gray image 52 with a certain grayscale level recorded in the state wherein the flocking of the rotatable member strike the surface of the photosensitive drum 21 straight on. As is clear from this comparison, where the gray image 51 according to this embodiment has a uniform grayscale level, a large number of lines appear in the gray image 52. This occurs because the tips of the flocking of the rotatable member strike the surface of the photosensitive drum 21 straight on so that charge is injected rapidly from the flocking tips, causing linear unevenness in the charge on the surface of the photosensitive drum 21.

Figure 5:
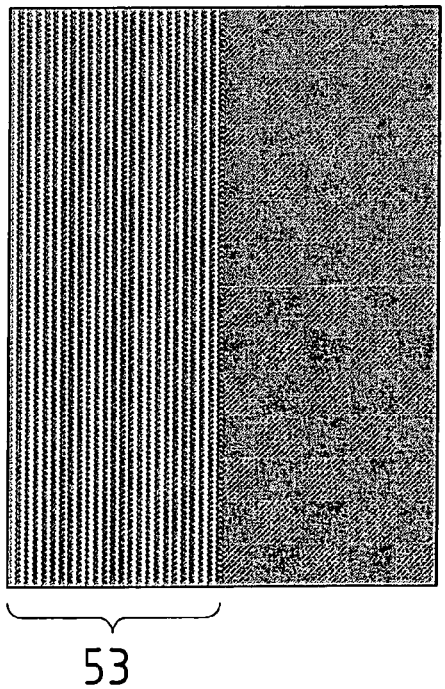
FIG. 5 is a diagram illustrating banding (band-shaped image defects) caused by uneven rotation of the photosensitive drum.

In addition, when the tips or midsections of the flocking of the rotatable member 41 glide over the surface of the photosensitive drum 21, the mechanical resistance between the rotatable member 41 and the photosensitive drum 21 is low so that the flocking of the rotatable member 41 and the surface of the photosensitive drum 21 are not readily worn. In addition, the mechanical resistance between the rotatable member 41 and the photosensitive drum 21 is low so that there is no need to increase the torque to the photosensitive drum 21. For this reason, any unevenness in rotation that may arise from increased torque to the photosensitive drum 21 does not occur, and the banding 53 (band-shaped image defects) as shown in FIG. 5 also does not occur.

Moreover, because the elastic material 44 is provided around the rotating shaft 43, when the rotatable member 41 is pressed against the photosensitive drum 21, not only the flocking of the rotatable member 41 but also the elastic material 44 also deforms elastically. Because of this elastic deformation of the elastic material 44, the flocking of the rotatable member 41 deform more flexibly and contact the surface of the photosensitive drum 21 more uniformly than when no elastic material 44 is present. Thereby, the surface of the photosensitive drum 21 is charged more evenly.

Figure 6:
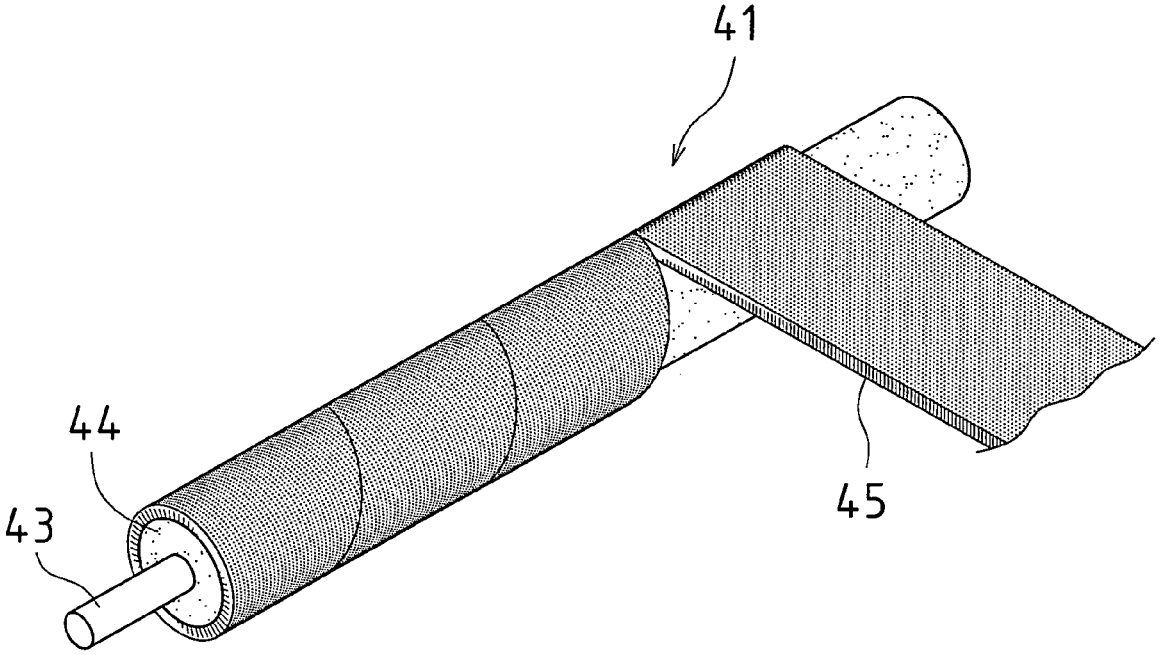
FIG. 6 is a perspective view showing a way of winding the brush cloth for the rotatable member in the brush-based charging apparatus of FIG. 2.

In addition, because the strip-shaped brush cloth 45 is wound in a spiral manner as shown in FIG. 6, the seams in the strip-shaped brush cloth 45 are spiral in shape. For this reason, when the flocking of the rotatable member 41 are put in contact with the photosensitive drum 21 with the rotatable member 41 and the photosensitive drum 21 rotating, the effects of the seams in the brush cloth 45 do not readily appear in the surface of the photosensitive drum 21.

Alternately, in the state in which the rotatable member 41 is not pressed against the photosensitive drum 21, the density of flocking becomes lower at the spiral-shaped seam, and this is thought to become the cause of uneven charging. However, the flocking of the rotatable member 41 deform flexibly due to elastic deformation of the elastic material 44 in the state in which the rotatable member 41 is pressed against the photosensitive drum 21, so that the flocking in the outer circumference of the spiral-shaped seams come closer, causing the density of flocking to be higher and the flocking of the rotatable member 41 to achieve uniform contact with the surface of the photosensitive drum 21 even near the spiral-shaped seam, so that the surface of the photosensitive drum 21 is uniformly charged.

Moreover, not only the flocking of the rotatable member 41 but also the elastic material 44 also deforms elastically, so that the pressure of the plurality of flocking making contact with the surface of the photosensitive drum 21 becomes more uniform, thus preventing disorders in the lie of the flocking. Thereby, a uniform charge continues to be maintained on the surface of the photosensitive drum 21.

In addition, the flocking of the rotatable member 41 and the elastic material 44 deform together, so that the load on the flocking of the rotatable member 41 is lessened, reducing the chances of crimping of the flocking of the rotatable member 41. Moreover, even if the flocking of the rotatable member 41 become crimped, recovery from this crimping occurs faster. Were there no elastic material 44, this recovery from crimping may take half a day, but if the elastic material 44 is present, this recovery from crimping takes less than 10 minutes.

On the other hand, with such a brush-based charging apparatus 22, there is a drawback in that residual developer on the photosensitive drum 21 or other fouling material may adhere to the rotatable member 41, thus fouling the rotatable member 41. If this fouling of the rotatable member 41 is left as is, this could cause uneven charging or damage to the photosensitive drum 21, thus leading to degraded image quality.

To solve this problem, the brush-based charging apparatus 22 is provided with a cleaning apparatus according to Embodiment 1 of the present invention for cleaning the rotatable member 41.

In the cleaning apparatus of this embodiment, a slide plate 47 is disposed on the left-hand side of the rotatable member 41, so that the slide plate 47 presses against the flocking of the rotatable member, 41, thus aligning the flocking of the rotatable member 41 in a certain direction. In addition, elastic foam body 46 is disposed above the rotatable member 41, so that the elastic foam body 46 presses against the flocking of the rotatable member 41, thus removing any developer or fouling material or the like attached to the flocking of the rotatable member 41.

Here, the slide plate 47 and the elastic foam body 46 are disposed in this order in the direction of rotation of the rotatable member 41. Accordingly, the slide plate 47 presses apart the plurality of the flocking of the rotatable member 41 to expose the vicinity of the base of each of the plurality of flocking. Immediately thereafter, the elastic foam body 46 presses against the tip to the vicinity of the base of each of the flocking, and thereby the elastic foam body 46 removes any developer or other fouling material adhering to the tip to the vicinity of the base of each of the flocking.

The slide plate 47 is made of Teflon® or another fluoropolymer, having a smooth surface 47*a* with a low friction coefficient.

The smooth surface 47*a* of the slide plate 47 has an extremely low friction coefficient, so that it presses apart the plurality of the flocking of the rotatable member 41 to expose the vicinity of the base of each of the flocking of the rotatable member 41 without damaging or pulling out the flocking of the rotatable member 41.

Further, the smooth surface 47*a* of the slide plate 47 aligns the flocking of the rotatable member 41 in the circumferential direction. It is thus possible to prevent uneven charging of the surface of the photosensitive drum 21 caused by disorder in the orientation of the flocking of the rotatable member 41.

The elastic foam body 46 is made of synthetic resin sponge, including single bubbles and open cells. Single bubbles are cells (bubbles) that appear alone, unconnected to other cells. Open cells refer to large numbers of cells connected to each other. The pressed face 46*a*, discharge face 46*b* and side faces 46*c* of the elastic foam body 46, that is, the outer circumferential surface of the elastic foam body 46, each has a large number of cell holes present on it, and these cell holes are connected to a large number of cells (open cells) within the elastic foam body 46.

The bottom face of the elastic foam body 46 serves as a pressed face 46*a* that is pressed against by the flocking of the rotatable member 41. In addition, the top face of the elastic foam body 46 serves as a discharge face 46*b*, with this discharge face 46*b* covered by a development recovery vessel 48. The pressed face 46*a* and discharge face 46*b* of the elastic foam body 46 are both open. Moreover, each of the side faces 46*c* of the elastic foam body 46 is sealed by a casing 49.

As the rotatable member 41 rotates, the tip to the vicinity of the base of each of the plurality of flocking of the rotatable member 41 is pressed against the pressed face 46*a* of the elastic foam body 46. Thus, the cell holes in the pressed face 46*a* of the elastic foam body 46 remove any developer or other fouling material adhering to the plurality of flocking of the rotatable member 41, and the developer or other fouling material thus removed is transferred to the cell holes in the above-described pressed face 46*a*, and thus each of the flocking of the rotatable member 41 is cleaned.

Figures 7, 8:
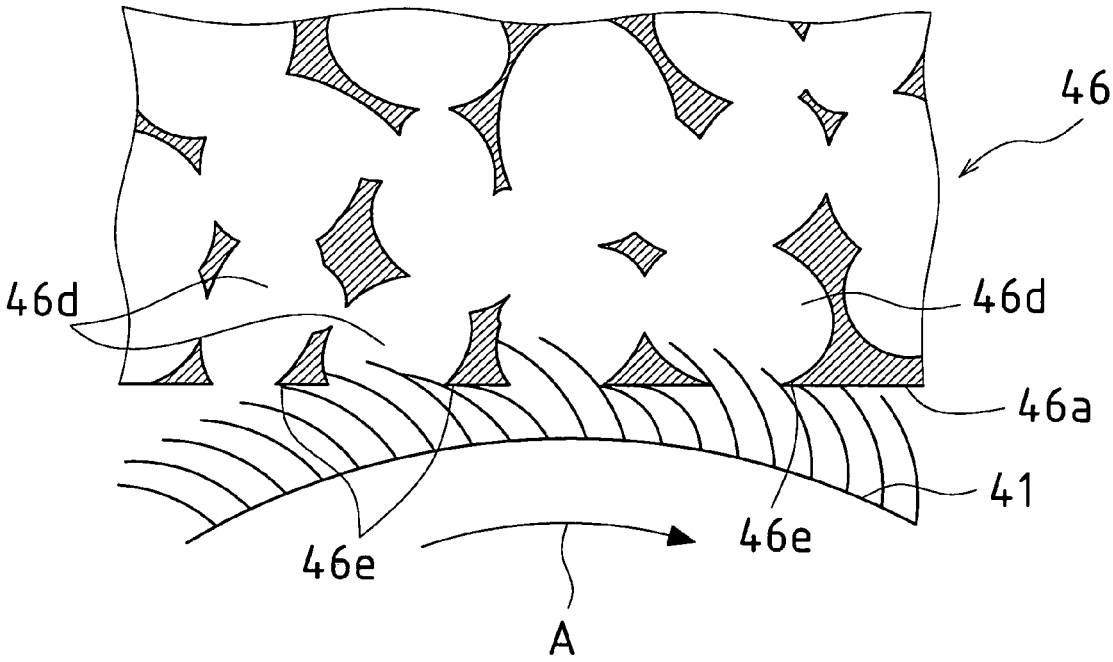
FIG. 7 is an enlarged cross-sectional view showing the pressed face of the elastic foam body.
FIG. 8 shows test data representing the change in image quality in accordance with increase in the number of sheets recorded, determined for each of various cell wall removal ratios by gradually changing the cell wall removal ratio of the elastic foam body.

Here, the pressed face 46*a* of the elastic foam body 46 is formed by polishing or cutting. By this polishing or cutting, the cross section of edges 46*e* of cell holes 46*d* that are exposed on the pressed face 46*a* of the elastic foam body 46 can be sharpened, as shown in FIG. 7. Then, with the sharpened edges 46*e* of the cell holes 46*d*, it is possible to favorably remove developer or other fouling material adhering to the flocking of the rotatable member 41.

In this case, the direction of polishing or cutting with respect to the pressed face 46*a* of the elastic foam body 46 is set constant to align the orientations of the edges 46*e* of the cell holes 46*d* that are to be sharpened. Then, as shown in FIG. 7, the elastic foam body 46 presses against the rotatable member 41, with the elastic foam body 46 disposed such that the orientation of the sharpened edges 46*e* of the cell holes 46*d* is opposite the direction of movement A of the outer circumference of the rotatable member 41. Thereby, it is possible to further enhance the ability of the cell holes 46*d* in the pressed face 46*a* of the elastic foam body 46 to remove fouling material.

As this cleaning of the flocking of the rotatable member 41 by the pressed face 46*a* of the elastic foam body 46 continues in this manner, the developer or other fouling material is continuously transferred to the cell holes 46*d* in the pressed face 46*a*, and when the cell holes in the pressed face 46*a* become full, the developer or other fouling material within the cell holes 46*d* in the pressed face 46*a* enters and moves into the plurality of cells (open cells) within the elastic foam body 46. Moreover, the developer or other fouling material within the elastic foam body 46 eventually reaches the discharge face 46*b* or the side faces 46*c* of the elastic foam body 46. The developer or other fouling material reaching the discharge face 46*b* of the elastic foam body 46 is discharged as is into the development recovery vessel 48 and recovered. In addition, the developer or other fouling material reaching the side faces 46*c* of the elastic foam body 46 avoids the side faces 46*c* because the side faces 46*c* are sealed with the casing 49, and thus continues moving toward the discharge face 46*b*, ultimately reaching the discharge face 46*b* and being discharged into the development recovery vessel 48 and recovered.

Accordingly, as the rotatable member 41 rotates, developer or other fouling material adhering to the flocking of the rotatable member 41 is removed by the pressed face 46*a* of the elastic foam body 46, the developer or other fouling material passes through the interior of the elastic foam body 46 and moves into the development recovery vessel 48 and is recovered.

In this way, the slide plate 47 presses apart the plurality of flocking of the rotatable member 41 to expose the vicinity of the base of each of the flocking, and the elastic foam body 46 removes the developer or the like adhering to the tip to the vicinity of the base of each of the flocking, thus preventing uneven charging of the surface of the photosensitive drum 21 caused by developer or other fouling material adhering to the flocking of the rotatable member 41. Moreover, the slide plate 47 aligns the flocking of the rotatable member 41 in a certain direction, so that it is possible to prevent uneven charging of the surface of the photosensitive drum 21 caused by disorder in the orientations of the flocking of the rotatable member 41.

Tests performed by the inventors of the present invention proved that the higher the cell wall removal ratio corresponding to the ratio of the open cells of the elastic foam body 46 is, that is, the higher the probability of connection between the cells of the elastic foam body 46 is, the more quickly developer or other fouling material passes through the cells of the elastic foam body 46 so that even more developer or other fouling material can be absorbed.

FIG. 8 shows test data representing the change in image quality in accordance with increase in the number of sheets recorded, determined for each of various cell wall removal ratios by gradually changing the cell wall removal ratio of the elastic foam body 46. Note that "O" indicates good image quality, and "X" indicates poor image quality.

As is evident from this test data, when the probability of connection between the cells of the elastic foam body 46 is suppressed to a low value by setting the cell wall removal ratio of the elastic foam body 46, for example, to 10 to 20%, image quality become poor before the number of sheets recorded by the image forming apparatus reaches 10000. This suggests that the amount of developer or other fouling material absorbed by the elastic foam body 46 is small.

On the other hand, when the probability of connection between the cells of the elastic foam body 46 is increased to a high value by setting the cell wall removal ratio of the elastic foam body 46 to 40%, good image quality is maintained until the number of sheets recorded by the image forming apparatus reaches 10000. This suggests that the amount of developer or other fouling material absorbed by the elastic foam body 46 is large.

Further, when the probability of connection between the cells of the elastic foam body 46 is increased to a higher value by setting the cell wall removal ratio of the elastic foam body 46 to higher than 50%, good image quality is maintained until the number of sheets recorded by the image forming apparatus reaches 20000. Still further, when the probability of connection between the cells of the elastic foam body 46 is increased to an even higher value by setting the cell wall removal ratio to higher than 60%, good image quality is maintained until the number of sheets recorded by the image forming apparatus reaches 30000. This suggests that the amount of developer or other fouling material absorbed by the elastic foam body 46 become even larger.

Therefore, it can be said that the higher the cell wall removal ratio corresponding to the ratio of the open cells of the elastic foam body 46 is, the more quickly developer or other fouling material passes through the cells of the elastic foam body 46 so that even more developer or other fouling material can be absorbed.

Here, the cell wall removal ratio of the elastic foam body 46 is set such that developer or other fouling material adhering to the rotatable member 41 can be continuously absorbed through the cells of the elastic foam body 46 during a single maintenance cycle of the image forming apparatus.

In general, a period of time in which from about 20000 to 30000 sheets of paper are recorded by the image forming apparatus is often set as a single maintenance cycle of the image forming apparatus. More specifically, the amount of toner accommodated in the toner bottle of the developing unit 24 is set to an amount required for recording about 20000 or 30000 sheets of paper. Furthermore, the life of the photosensitive layer of the photosensitive drum 21 is set to such a length that allows about 20000 or 30000 sheets of paper to be recorded.

Therefore, based on the test data of FIG. 8, the cell wall removal ratio of the elastic foam body 46 is set to at least 60% or at least 80%. When the cell wall removal ratio of the elastic foam body 46 is set to at least 60%, good image quality can be reliably maintained until the number of sheets recorded by the image forming apparatus reaches 20000. Furthermore, when the cell wall removal ratio of the elastic foam body 46 is set to at least 80%, good image quality can be reliably maintained until the number of sheets recorded by the image forming apparatus reaches 30000.

Then, maintenance is performed for the image forming apparatus when the number of recorded sheets has reached 20000 or 30000, and the elastic foam body 46 is exchanged, together with the toner bottle of the developing unit 24 or the photosensitive drum 21. Thus, it is possible to simplify the maintenance.

Furthermore, it is possible to exchange the rotatable member 41, or the brush-based charging apparatus 22, at the same time of exchanging the elastic foam body 46. Alternatively, if the brush-based charging apparatus 22 forms a unit with the photosensitive drum 21, then it is possible to exchange this unit.

If a period of time in which about 10000 sheets of paper are recorded is set as a maintenance cycle of the image forming apparatus, the maintenance cycle will be too short, so that it is necessary to perform maintenance frequently. If a period of time in which 40000 or more sheets of paper are recorded is set as a maintenance cycle of the image forming apparatus, it will be necessary to increase the amount of toner accommodated in the toner bottle of the developing unit 24, or to extend the life of various expendable parts, producing many problems to be solved, which would be impracticable.

The cell wall removal ratio of the elastic foam body 46 can be adjusted by pressurizing the elastic foam body 46. In this case, the cell wall removal ratio can be increased by increasing the pressure applied to the elastic foam body 46, or by increasing the number of times of pressurization.

Furthermore, the cell wall removal ratio can be adjusted by impregnating the elastic foam body 46 with a solvent. In this case, the cell wall removal ratio can be increased by increasing the amount of the solvent with which the elastic foam body 46 is impregnated, or by increasing the period of time of impregnation.

However, if the cell wall removal ratio of the elastic foam body 46 is increased excessively, then the strength and durability of the elastic foam body 46 are reduced. Therefore, it is necessary to suppress the cell wall removal ratio of the elastic foam body 46 to a cell wall removal ratio that allows the practical strength and durability of the elastic foam body 46 to be maintained, or lower.

Figure 9:
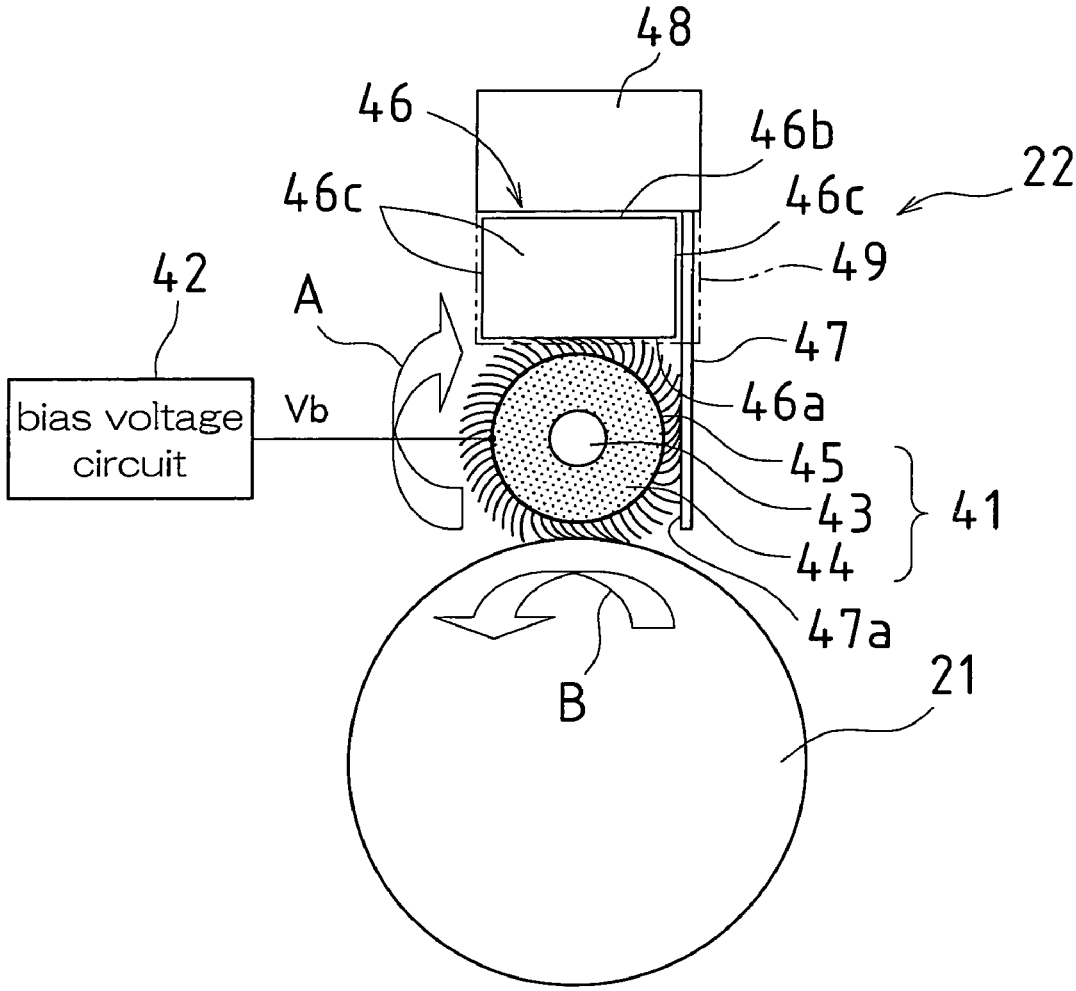
FIG. 9 is a side view showing a modification of the brush-based charging apparatus of FIG. 2.

Note that the cleaning apparatus of the present invention is in no way limited to the aforementioned embodiments but rather various modifications are possible. For example, as shown in FIG. 9, the elastic foam body 46 may be provided downstream in the direction of rotation of the rotatable member 41 from the area of contact with the surface of the photosensitive drum 21, and the slide plate 47 may be provided downstream in the direction of rotation of the rotatable member 41 from the elastic foam body 46. In this case, the elastic foam body 46 presses against the flocking of the rotatable member 41 and removes any developer or other fouling material adhering to the flocking of the rotatable member 41, and the flocking of the rotatable member 41 disordered at this time then press against the slide plate 47, and thereby the flocking of the rotatable member 41 can be aligned in a certain direction. Thus, uneven charging of the surface of the photosensitive drum 21 caused by developer or other fouling material adhering to the flocking of the rotatable member 41 is prevented, and uneven charging of the surface of the photosensitive drum 21 due to disorder in the orientation of the flocking of the rotatable member 41 is also prevented.

Embodiment 2

Figure 10:
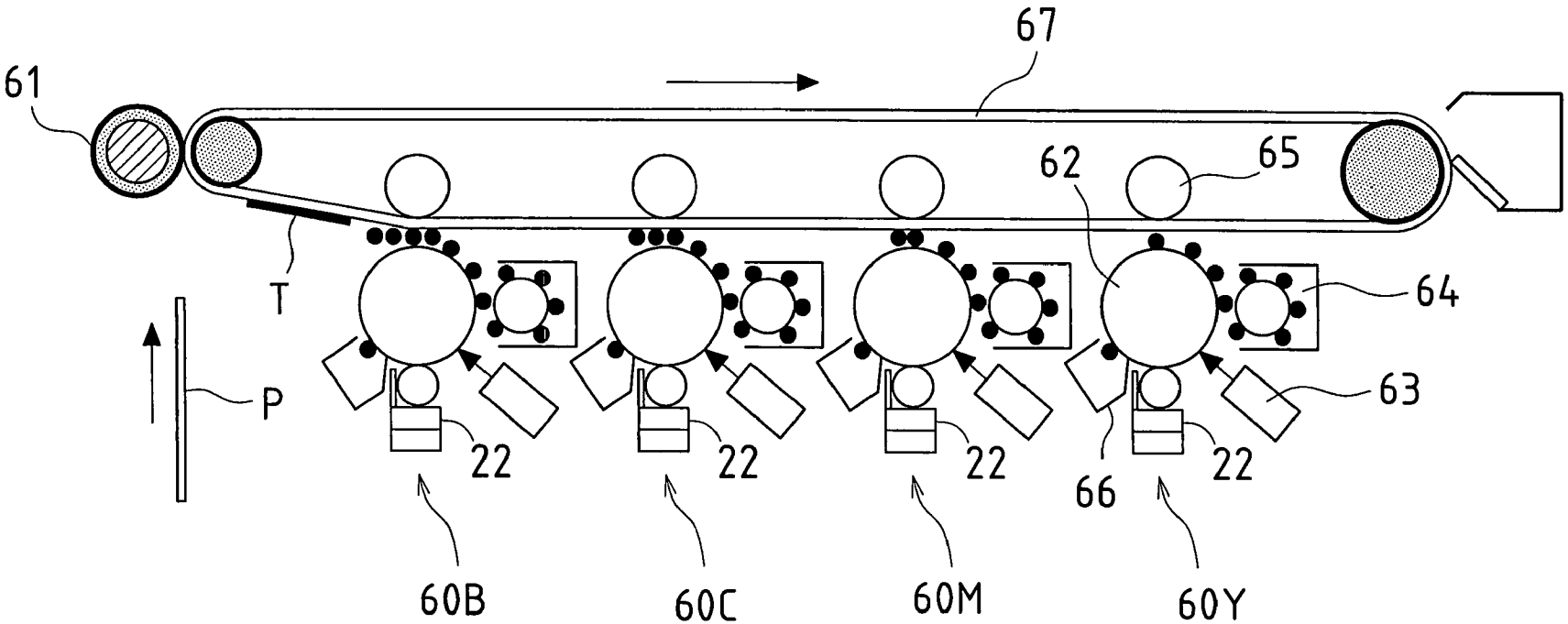
FIG. 10 is a schematic side view showing an Embodiment 2 of the image forming apparatus according to the present invention.
Figure 11:
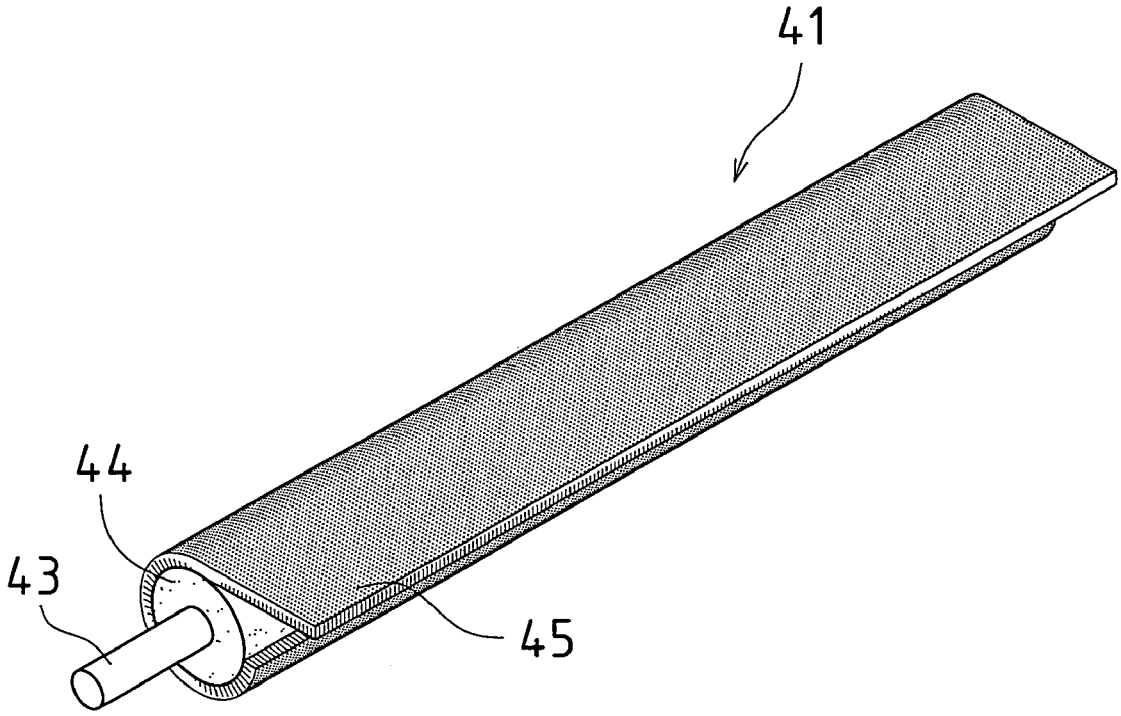
FIG. 11 is a perspective view showing another way of winding the brush cloth for the rotatable member in the brush-based charging apparatus of FIG. 2.

FIG. 10 is a schematic side view showing an image forming apparatus according to Embodiment 2 of the present invention. This image forming apparatus is used to form color images, being provided with four visible image forming units 60Y, 60M, 60C and 60B, and a transfer-fixing roller 61.

In each of the visible image forming units 60Y, 60M, 60C and 60B, a brush-based charging apparatus 22, a laser scan unit 63, a developing unit 64, a transfer roller 65 and a cleaner 66 are disposed around a photosensitive drum 62. The developing unit 64 of each of the visible image forming units 60Y, 60M, 60C and 60B contains toner of one of the colors yellow (Y), magenta (M), cyan (C) and black (B). Moreover, in the visible image forming units 60Y, 60M, 60C and 60B, once a uniform charge is applied to the surface of the photosensitive drum 62 by the brush-based charging apparatus 22, the laser beam of the laser scan unit 63 is modulated depending on the image information-while the laser beam is shined onto the surface of the photosensitive drum 62, thus forming an electrostatic latent image on the surface of the photosensitive drum 62. Then, the developing unit 64 causes toner to adhere to the electrostatic latent image upon the surface of the photosensitive drum 62 and thus forms a toner image on the surface of the photosensitive drum 62. The transfer roller 65 to which is applied a bias voltage of a polarity opposite that of the toner is used to transfer the toner image on the surface of the photosensitive drum 62 to an intermediate transfer belt 67.

Each of the visible image forming units 60Y, 60M, 60C and 60B forms a toner image in one of the colors upon the surface of the photosensitive drum 62, and the various-colored toner images are sequentially transferred onto the intermediate transfer belt 67 such that they overlap. Thereby, a single color toner image T is formed upon the intermediate transfer belt 67. The transfer-fixing roller 61 transfers and fixes this color toner image T to the recording paper P.

In this color image forming apparatus, it is necessary to provide the same number of brush-based charging apparatuses 22 and photosensitive drums 62 as the number of toner colors, so that if four colors are used, for example, then it is necessary to provide four sets of brush-based charging apparatus 22 and photosensitive drum 62. For this reason, were corona-discharge type charging apparatus to be used, large amounts of ozone would be generated, causing not only the acrid smell of ozone, but also the problem of deterioration of the photosensitive drum 62 due to ozone.

However, the brush-based charging apparatus 22 is the same as that of the image forming apparatus of FIG. 1, so that the amount of ozone generated is extremely small.

Moreover, the brush-based charging apparatus 22 is disposed below the photosensitive drum 21, so that developer or other fouling material from the rotatable member 41 does not go against the force of gravity and is removed by the cells of the elastic foam body 46, and thus developer or other fouling material passes through the cells in the elastic foam body 46 and flows downward toward the discharge face 46*b* below, and can be discharged into the development recovery vessel 48, thereby increasing the efficiency of removal of fouling material.

Note that the present invention is in no way limited to the aforementioned embodiments but rather various modifications are possible. For example, where the flocking of the brush cloth 45 are given a crimp so as to be inclined at the outer circumferential surface of the rotatable member 41, instead, the flocking of the brush cloth 45 may be provided radially with respect to the rotating shaft 43, and the peripheries of the rotatable member 41 and photosensitive drum 21 may be moved in the same direction in their area of contact, thus making the circumferential speed of the rotatable member 41 faster than that of the photosensitive drum 21. Thereby also, the flocking of the rotatable member 41 are inclined so that their grain is in the direction of rotation of the surface of the photosensitive drum 21, and thus the flocking of the brush cloth 45 are inclined to be aligned in the circumferential direction of the rotatable member 41.

In addition, rather than causing the brush cloth 45 to adhere by spiral winding, as shown in FIG. 1, the brush cloth 45 may also be caused to adhere by wrapping round the elastic material 44 in the same manner that cigarette paper is wrapped around a cigarette. In this case, the flocking of the brush cloth 45 are oriented radially with respect to the rotating shaft 43, so that the flocking of the brush cloth 45 are easily inclined to be aligned in the circumferential direction of the rotatable member 41.

Note that the cleaning apparatus according to the present invention can be applied not only to the rotatable member 41 of a brush-based charging apparatus 22, but also to the cleaning brush of a cleaning unit 26, the discharge brush of a discharge unit (not shown) and the like in the image forming apparatus 1, and moreover it may be applied to any rotatable member regardless of the structure of the rotatable member. Further, in another contact type of charging roller (rotatable member), it is possible to enhance the performance of the contact type of charging roller by setting the cell wall removal ratio to at least 60%, as in the rotatable member 41 of the brush-based charging apparatus 22 according to this embodiment.

The present invention can be embodied and practiced in other different forms without departing from the spirit and essential characteristics thereof Therefore, the above-described embodiments are considered in all respects as illustrative and not restrictive. For example, the present invention achieves useful effects when applied to a cleaning apparatus for a contact type of charging roller that is made of a conductive elastomer and that contacts a photoreceptor to apply charge to the photoreceptor. The scope of the invention is indicated by the appended claims rather than by the foregoing description. All variations and modifications falling within the equivalency range of the appended claims are intended to be embraced therein.

What is claimed is:

1. A cleaning apparatus for a rotatable member for cleaning a rotatable member that abuts upon or slides along an electrostatic latent bearing member in order to apply an electric potential to the electrostatic latent bearing member, comprising:

an elastic foam body with open cells that is pressed against by the rotating member, wherein a cell wall removal ratio corresponding to a ratio of the open cells of the elastic foam body is set in accordance with a maintenance cycle.

2. A cleaning apparatus for a rotatable member for cleaning a rotatable member that abuts upon or slides along an electrostatic latent bearing member in order to apply an electric potential to the electrostatic latent bearing member, comprising:

an elastic foam body with open cells that is pressed against by the rotating member, wherein a cell wall removal ratio corresponding to a ratio of the open cells of the elastic foam body is set to at least 60%.

3. A cleaning apparatus for a rotatable member for cleaning a rotatable member that abuts upon or slides along an electrostatic latent bearing member in order to apply an electric potential to the electrostatic latent bearing member, comprising:

an elastic foam body with open cells that is pressed against by the rotating member, wherein a cell wall removal ratio corresponding to a ratio of the open cells of the elastic foam body is set to at least 80%.

4. The cleaning apparatus for a rotatable member according to any one of claims 1 to 3, wherein the cell wall removal ratio is adjusted by pressurizing the elastic foam body.

5. The cleaning apparatus for a rotatable member according to any one of claims 1 to 3, wherein the cell wall removal ratio is adjusted by impregnating the elastic foam body with a solvent.

6. The cleaning apparatus for a rotatable member according to any one of claims 1 to 3, wherein an outer circumferential surface of the elastic foam body that is pressed against by the rotatable member is formed by polishing or cutting.

7. The cleaning apparatus for a rotatable member according to any one of claims 1 to 3, wherein the cross section of edges of cell holes that are exposed on an outer circumferential surface of the elastic foam body is sharpened by polishing or cutting, with a direction of the polishing or cutting with respect to the outer circumferential surface of the elastic foam body being set constant.

8. The cleaning apparatus for a rotatable member according to any one of claims 1 to 3, wherein the elastic foam body presses against the rotatable member, with the elastic foam body being disposed such that the orientation of the edges of the cell holes whose cross section has been sharpened is opposite a direction of movement of the outer circumference of the rotatable member.

9. A cleaning apparatus for a rotatable member for cleaning a rotatable member that abuts upon or slides along an electrostatic latent bearing member in order to apply an electric potential to the electrostatic latent bearing member, comprising:

an elastic foam body that is pressed against by the rotatable member downstream in a direction of rotation of the rotatable member from an area of contact with the electrostatic latent bearing member;

wherein the elastic foam body is an elastic foam body with oven cells, has a contacting face that contacts the rotatable member, a discharge face that discharges developer or the like that enters the elastic foam body, and all faces other than the contacting face and the discharge face are sealed.

10. A cleaning apparatus for a rotatable member for cleaning a rotatable member that abuts upon or slides along an electrostatic latent bearing member in order to apply an electric potential to the electrostatic latent bearing member, comprising:

a slide member that is pressed against by the flocking of the rotatable member downstream in a direction of rotation of the rotatable member from an area of contact with the electrostatic latent bearing member; and an elastic foam body that is pressed against by the flocking of the rotatable member downstream in the direction of rotation of the rotatable member from the slide member, wherein the slide member has a smooth surface so that the orientations of the flocking of the rotatable member are aligned by the flocking of the rotatable member pressing against the smooth surface.

11. The cleaning apparatus for a rotatable member according to claim 10, wherein the elastic foam body is an elastic foam body with open cells.

12. The cleaning apparatus for a rotatable member according to claim 11, wherein the elastic foam body has a contacting face that contacts the rotatable member, a discharge face that discharges developer or the like that enters the elastic foam body, and all faces other than the contacting face and the discharge face are sealed.

13. The cleaning apparatus for a rotatable member according to claim 9 or 10, wherein the rotatable member contacts the bottom surface of the electrostatic latent bearing member.

14. A cleaning apparatus for a rotatable member for cleaning a rotatable member that abuts upon or slides along an electrostatic latent bearing member in order to apply an electric potential to the electrostatic latent bearing member, comprising:

an elastic foam body that is pressed against by the rotatable member downstream in a direction of rotation of the rotatable member from an area of contact with the electrostatic latent bearing member, wherein the rotatable member contacts the bottom surface of the electrostatic latent bearing member.

* * * * *